US006805535B2

(12) United States Patent
Tiemann

(10) Patent No.: US 6,805,535 B2
(45) Date of Patent: Oct. 19, 2004

(54) DEVICE AND METHOD FOR PRODUCING A BLADE FOR A TURBINE AND BLADE PRODUCED ACCORDING TO THIS METHOD

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 49 days.

(21) Appl. No.: 10/239,792

(22) PCT Filed: Sep. 13, 2001

(86) PCT No.: PCT/EP01/10600

§ 371 (c)(1),
(2), (4) Date: Sep. 25, 2002

(87) PCT Pub. No.: WO02/22291

PCT Pub. Date: Mar. 21, 2002

(65) Prior Publication Data

US 2003/0047298 A1 Mar. 13, 2003

(30) Foreign Application Priority Data

Sep. 14, 2000 (EP) ..... 00120035

(51) Int. Cl.[7] ..... F01D 5/18
(52) U.S. Cl. ..... 416/233; 29/889.721
(58) Field of Search ..... 416/233, 232, 416/97 R; 29/889, 889.7, 899.72, 889.721; 164/137, 340; 415/115, 915

(56) References Cited

U.S. PATENT DOCUMENTS 5,813,835 A * 9/1998 Corsmeier et al. ..... 416/97 R

FOREIGN PATENT DOCUMENTS

| | | |
|---|---|---|
| EP | 0585183 | 3/1994 |
| EP | 1027943 | 8/2000 |
| GB | 628522 | 8/1949 |
| WO | 9959748 | 11/1999 |

* cited by examiner

*Primary Examiner*—Edward K. Look
*Assistant Examiner*—Dwayne White
(74) *Attorney, Agent, or Firm*—Harness, Dickey & Pierce, P.L.C.

(57) ABSTRACT

A device and a method are for producing a blade including two outer walls and at least one cavity between the outer walls, for a turbine. An outer mould and several cores are used in forming the outer walls and the at least one cavity of the blade. At least one of the cavities is divided into two channels by a middle segment. One channel is located between the first outer wall and the middle segment, while the other channel is located between the middle segment and the second outer wall. Two cores which are separate from each other are used accordingly. This provides a simple and economical means of reducing the thickness of the outer wall.

18 Claims, 3 Drawing Sheets

DEVICE AND METHOD FOR PRODUCING A BLADE FOR A TURBINE AND BLADE PRODUCED ACCORDING TO THIS METHOD

This application is the national phase under 35 U.S.C. §371 of PCT International Application No. PCT/EP01/10600 which has an International filing date of Sep. 13, 2001, which designated the United States of America and which claims priority on European Patent Application number EP 00120035.1 filed Sep. 14, 2000, the entire contents of which are hereby incorporated herein by reference.

FIELD OF THE INVENTION

The present invention generally relates to a device for producing a blade having two outer walls and at least one cavity, arranged between the outer walls, for a turbine, comprising an outer mold and a plurality of cores for forming the outer walls and the at least one cavity.

The invention also generally relates to a method of producing a blade having two outer walls and at least one cavity, arranged between the outer walls, for a turbine, an outer mold and a plurality of cores being provided for forming the outer walls and the at least one cavity.

Further general subject matter of the invention includes a blade for a turbine, in particular a gas turbine, having two outer walls and at least one cavity arranged between the outer walls.

BACKGROUND OF THE INVENTION

Blades, in particular blades for gas turbines, must be cooled from inside on account of the high operating temperatures. For this purpose, the blades have one or more cavities. In the hitherto known blades, these cavities extend from the one outer wall of the blade up to the other outer wall. A section of a core is provided for forming each cavity. The individual sections are connected to one another. The core is accommodated in a suitable receptacle of an outer mold for producing the blade by a casting process. In this case, the length of the core can assume comparatively high values.

In blades cooled from inside, the wall thickness of the outer walls is to be selected to be as small as possible. A substantial improvement in the cooling can be achieved by a small wall thickness. The minimum wall thickness provided must always be greater than the tolerance of the wall thickness. Otherwise, there is the risk of the core being displaced and/or deformed during the casting in such a way that it comes into contact with the outer mold and the blade produced has a hole. In practice, therefore, a comparatively large wall thickness must be selected.

A further disadvantage of the known methods is that shifting of the core during the casting has consequences for both outer walls of the blade. The reason for this is that the core extends from the one outer wall up to the other outer wall. Therefore, the core has to be produced with high precision in these known methods. Tolerances which occur during the production of the core must likewise be taken into account.

To improve the cooling, blades having cavities are known. Such a blade and also a method and a device for producing it have been disclosed by WO 99/59748 originating from the same applicant. This publication proposes a multiplicity of cores which are connected to one another and the outer mold via connecting elements. The production of this blade is complicated and costly.

SUMMARY OF THE INVENTION

An object of a preferred embodiment of the present invention is therefore to provide a simple and cost-effective device and a cost-effective method for producing a blade with small wall thicknesses. A further object of an embodiment of the invention is to provide a blade for a turbine, this blade having outer walls with a substantially smaller wall thickness.

The device according to an embodiment of the invention provides for each of the cores to have at least one section which extends from an associated outer wall up to a center web of the blade without being involved in the formation of the other outer wall.

The method according to an embodiment of the invention is characterized in that at least one section of each core is supported in such a way that the distance between the outside of the section of the one core and the inside of the outer mold is independent of the distance between the outside of the section of the other core and the inside of the outer mold, so that the wall thicknesses of the two outer walls, at least in the region of the sections, are formed independently of one another.

According to an embodiment of the invention, in a blade of the type mentioned at the beginning, this object is achieved in that at least one cavity is divided into two passages by a center web, the one passage being arranged between the one outer wall and the center web and the other passage being arranged between the center web and the other outer wall.

One basic idea of an embodiment of the invention is that the two outer walls of the blade are produced independently of one another at least in sections. At least one cavity of the blade is divided into two passages by a center web. The one passage extends from the first outer wall up to the center web and the other passage extends from the center web up to the second outer wall. A plurality of cores are provided. A first core has one or more sections for forming the passages between the first outer wall and the center web. The further passages are formed by sections of a second core which is provided separately from the first core. Displacements and deformations of the first core which bring about a change in the wall thickness of the one outer wall are not transmitted to the second core. The wall thickness of the two outer walls, at least in regions, are therefore formed independently of one another.

The method according to an embodiment of the invention provides for those sections of each core which serve to form the passages to be supported in such a way that a minimum wall thickness is ensured. Projections which are supported on the inside of the outer mold are advantageously used for this purpose.

During the production of the cores, only the outside, facing the inside of the outer mold, of the sections is critical for the wall thickness of the outer walls. In particular, comparatively coarse tolerances may be applied to the side of the sections which is assigned to the center web. As a result, the production accuracy of the outside of the cores can be substantially improved, the outside of the cores being critical for the wall thickness of the outer walls. All the tolerances are shifted into the region of the center web. This does not result in disadvantages for the cooling effect, since the hot fluid flowing through the turbine is not admitted directly to the center web. Furthermore, the center web is cooled on both sides by the passages. The center web also provides the requisite strength for the blade when the outer walls have small wall thicknesses.

According to an advantageous development of an embodiment of the invention, the cores are provided with projections for supporting on the outer mold. They are then advantageously supported on one another during the casting and pressed against the inside of the outer mold. The support may be effected by rigid, in particular wedge-shaped, or elastic spacers.

With this procedure, a minimum wall thickness for the outer walls is reliably maintained. Displacements of the cores toward the inside are avoided by the cores being supported on one another. For the production of the cores, this means that only the outside facing the inside of the outer mold has to be produced with high precision. Due to the two cores being supported on one another, the accuracy to size of the further outsides is only of secondary importance. Greater rigidity than in the known devices and methods is also achieved due to the cores being supported on one another. Displacements or deformations of the cores during the casting are therefore reduced. The tolerance range for the wall thickness of the outer walls can therefore be markedly reduced, so that thinner walls overall may be provided.

The projections serving for the support on the outer mold advantageously taper starting from the cores. In particular, they may be of conical design. This ensures that only point-like openings are produced in the outer walls, through which openings only minimum cooling medium escapes. Despite the support on the inside of the outer mold, the desired high cooling efficiency is therefore maintained.

The cores may be fixed at one or both ends in a receptacle of the outer mold in the longitudinal direction of the blade. Fixing solely in the longitudinal direction is sufficient if the support is effected in the transverse direction by the projections on the cores. The position of the cores during the production of the wax tool and during the casting is thereby ensured.

The outer walls are advantageously connected to one another via a plurality of ribs for forming a plurality of cavities. This results in specific cooling of individual regions of the blade with increased strength.

According to an advantageous development, a cavity at a leading edge and/or a trailing edge of the blade is free of the center web. The reason for this is that an increased cooling effect is required in the region of the leading edge. The cooling effect would be impaired in the junction region of the center web. This also correspondingly applies to the trailing edge.

In an advantageous configuration, the wall thickness of the center web is greater than the wall thickness of the outer walls. The requisite strength of the blade is then ensured by the center web and possibly the ribs. The wall thickness of the outer walls can accordingly be reduced.

BRIEF DESCRIPTION OF THE DRAWINGS

The invention is described in more detail below with reference to an exemplary embodiment which is shown schematically in the drawings, in which.

DETAILED DESCRIPTION OF THE PREFERRED EMBODIMENTS

Figure 1:
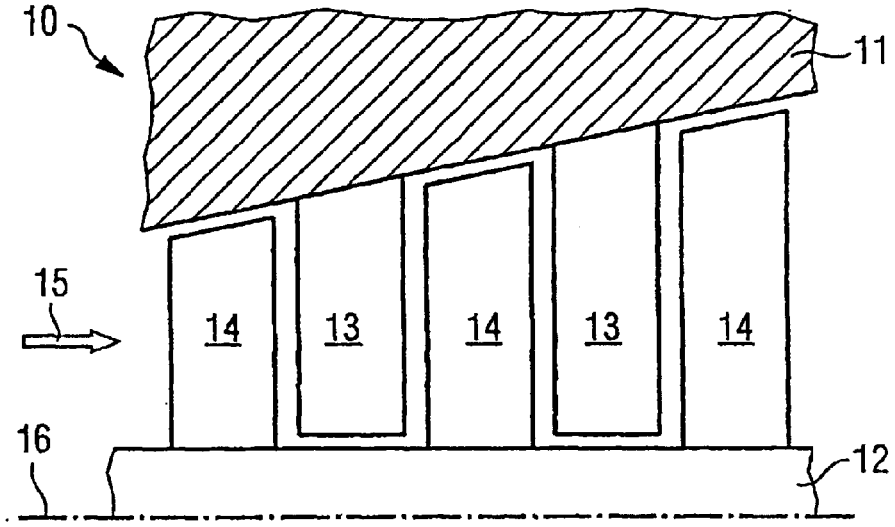
FIG. 1 shows a schematic longitudinal section through a gas turbine.

FIG. 1 shows a schematic longitudinal section through a gas turbine 10 having a casing 11 and a rotor 12. Guide blades 13 are attached to the casing 11 and moving blades 14 are attached to the rotor 12. A hot medium, in particular a gas, flows through the turbine 10 in arrow direction 15. On account of this flow, the rotor 12 is set in rotation about an axis 16 relative to the casing 11. The blades 13, 14 must be cooled from inside on account of the high prevailing temperature.

Figure 2:
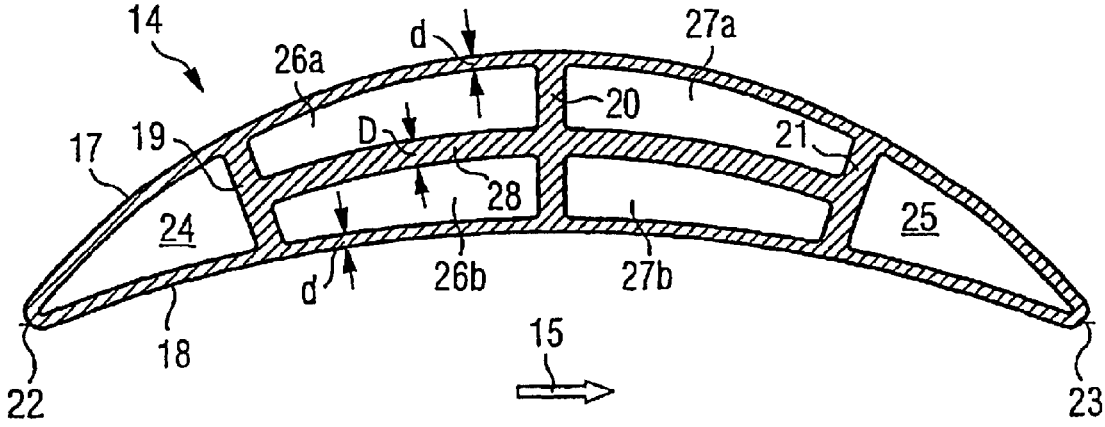
FIG. 2 shows a cross section through a moving blade of the turbine.

FIG. 2 shows a cross section through a moving blade 14 of the turbine 10. The guide blades 13 are essentially constructed in a similar manner. The moving blade 14 has two outer walls 17, 18 which are connected via three ribs 19, 20, 21. The ribs 19, 20, 21 are approximately perpendicular to the outer walls 17, 18. At their two ends, the outer walls 17, 18 merge into a leading edge 22 and a trailing edge 23, respectively. The flow against the blade 14 according to arrow direction 15 takes place from the leading edge 22 to the trailing edge 23.

The intermediate space between the outer walls 17, 18 is subdivided into a plurality of cavities 24, 25, 26, 27 by the ribs 19, 20, 21. The cavities 26, 27 lying in the center of the moving blade 14 are each divided into two passages 26*a*, 26*b*, 27*a*, 27*b* by a center web 28. In this case, the passages 26*a*, 27*a* are arranged between the first outer wall 17 and the center web 28. The further passages 26*b*, 27*b* are located between the center web 28 and the second outer wall 18. The cavities 24, 25 in the region of the leading edge 22 and the trailing edge 23 are free of the center web 28.

The wall thickness D of the center web 28 is greater than the wall thickness d of the outer walls. The center web 28 runs from the front rib 19 via the center rib 20 up to the rear rib 21. It is arranged approximately in the axial profile center of the moving blade 14. The center web 28, together with the ribs 19, 20, 21, provides the strength required by the moving blade 14 for operation. The outer walls 17, 18 may therefore be of thin design.

Figure 3:
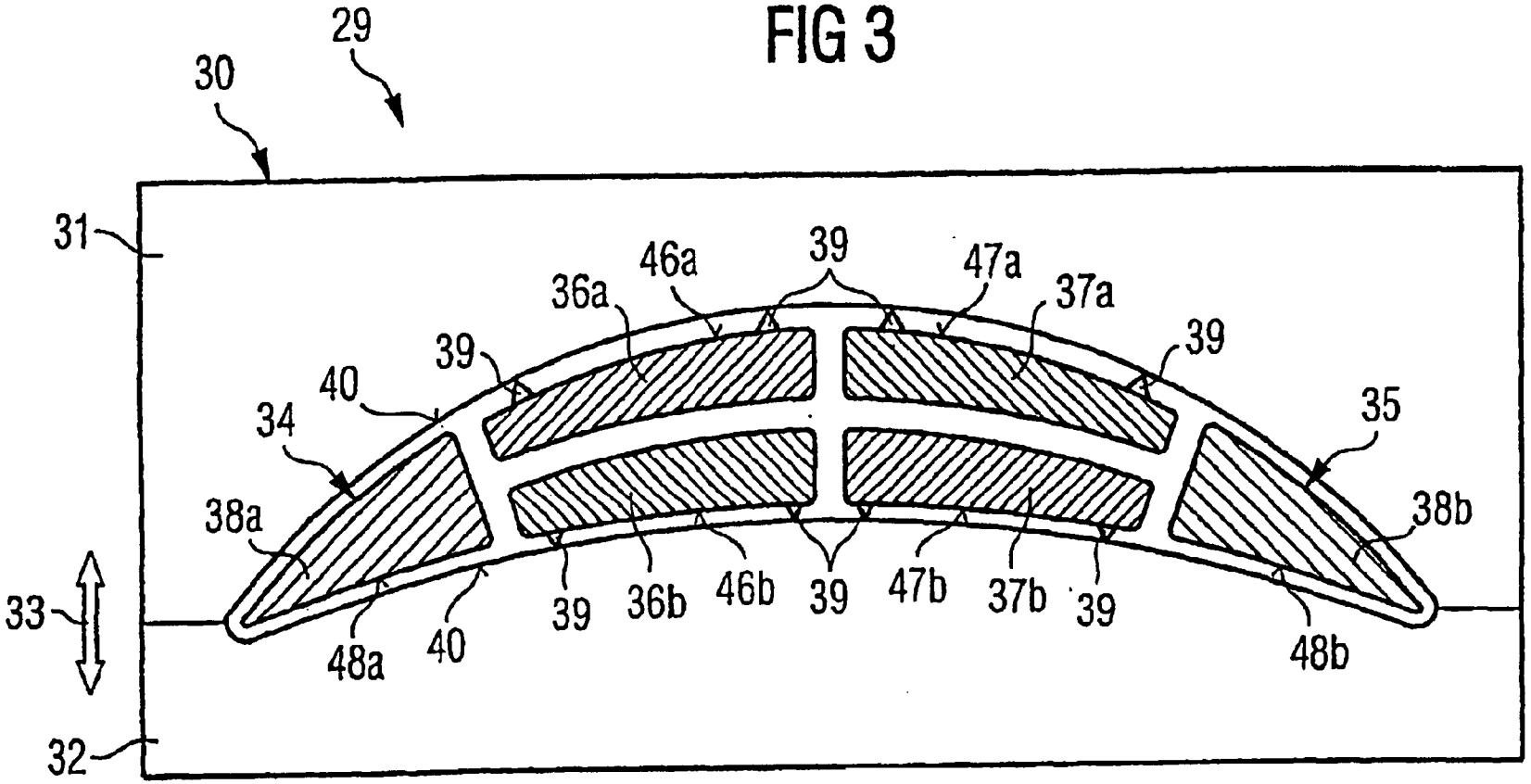
FIG. 3 shows a cross section through the device provided according to an embodiment of the invention for producing the blade.

FIG. 3 shows a cross section through a device 29 according to the invention for producing a blade 13, 14. An outer mold 30 having two mold parts 31, 32 is provided, it being possible for the mold parts 31, 32 to be moved away from one another and toward one another according to arrow direction 33. Two cores 34, 35 formed separately from one another are inserted between the two mold parts 31, 32. The first core 34 has three sections 36*a*, 37*a*, 38*a*. The sections 36*a*, 37*a* serve to form the passages 26*a*, 27*a*. The section 38*a* forms the cavity 24 in the region of the leading edge 22.

The second core 35 is designed essentially in a similar manner with sections 36*b*, 37*b*, 38*b*. Here, too, two sections 36*b*, 37*b* are provided for forming the passages 26*b*, 27*b*. The cavity 25 in the region of the trailing edge 23 is formed by the section 38*b*. The individual sections 36*ab*, 37*ab*, 38*ab* of the cores 34, 35 are connected to one another.

The sections 36*ab*, 37*ab* for forming the passages 26*a*, 26*b*, 27*a*, 27*b* have projections 39 for supporting on an inside 40 of the outer mold 30. The projections 39 taper and are of conical design. They provide the minimum distance between the inside 40 of the outer mold and a respectively associated outside 46*a*, 47*a*, 46*b*, 47*b* of the sections 36*a*, 36*b*, 37*a*, 37*b*. This distance essentially corresponds to the wall thickness d of the outer walls 17, 18. The wall thickness D of the center web 28 is established by the distance between the sections 36*a*, 37*a* and the sections 36*b*, 37*b*.

For the production, only the outsides 46*a*, 47*a*, 46*b*, 47*b* of the sections 36*a*, 37*a*, 36*b*, 37*b* and also the outsides 48*a*, 48*b* of the sections 38*a*, 38*b* have to be machined with high precision. The further surfaces of the cores 34, 35 may have comparatively large tolerances, since they are not important for establishing the wall thickness d of the outer walls 17, 18.

Figure 4:
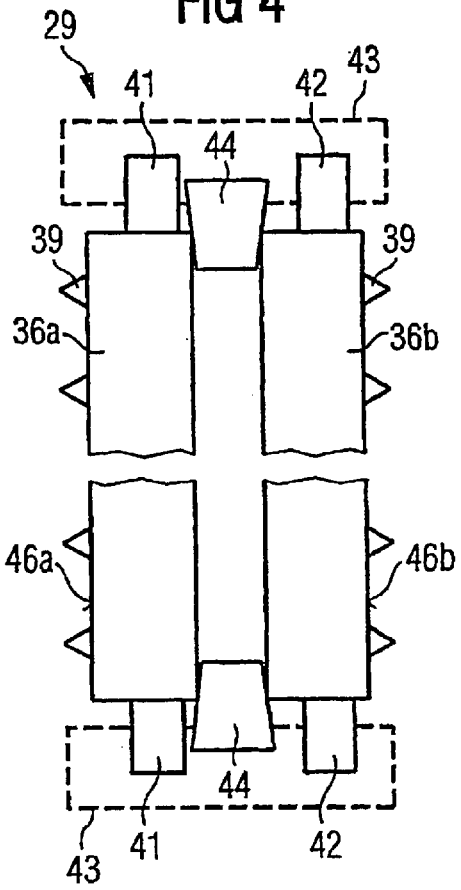
FIG. 4 shows a schematic side view of the mounting of the cores in the device according to an embodiment of the invention.
Figure 5:
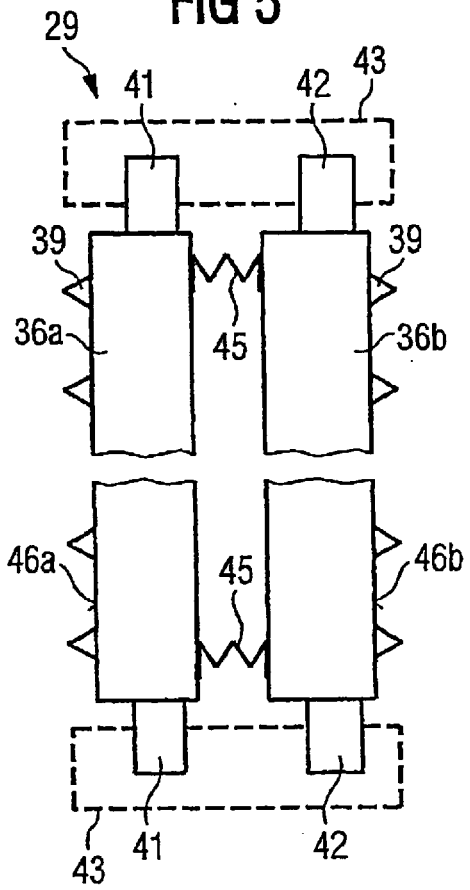
FIG. 5 shows a view similar to FIG. 4 in a further configuration.

FIGS. 4 and 5 show the mounting of the cores 34, 35 in the device 29. At both ends, each of the cores 34, 35 has projections 41, 42 for fastening in a receptacle 43 (shown by broken lines) of the device 29 according to the invention. The two cores 34, 35 are supported on one another via spacers 44, 45. As a result, the projections 39 are pressed against the inside 40 of the outer mold 30. The use of rigid spacers 44 is shown in FIG. 4 and the use of elastic spacers 45, in particular of spring-like design, is shown in FIG. 5.

In the device according to an embodiment of the invention, the minimum wall thickness d of the outer walls 17, 18 is ensured by the cores 34, 35 being supported with the projections 39 on the inside 40. On account of the taper of the projections 39, only a point-like opening is produced in the outer walls 17, 18 of the completed blade 13, 14. Displacement of the cores 34, 35 toward one another is prevented by the spacers 44, 45. It is thus ensured that the desired wall thickness d of the outer walls 17, 18 is reliably maintained. The tolerances of the wall thickness d which occurred hitherto can be substantially reduced. The wall thickness d can therefore be reduced right from the beginning at the design stage compared with the known blades 13, 14 and devices 29.

A further advantage is that the wall thicknesses d of the outer walls 17, 18 no longer depend on one another. A displacement or deformation of the core 34 does not lead to a change in the wall thickness d of the outer wall 18. A displacement or deformation of the core 35 also does not lead to a change in the wall thickness d of the outer wall 17.

Figure 6:
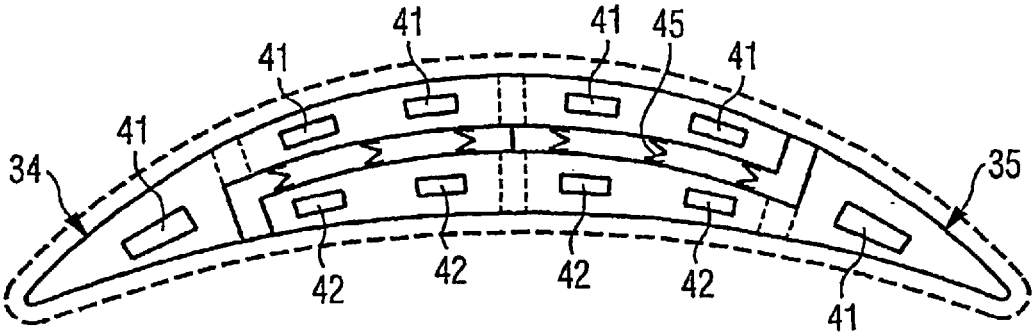
FIG. 6 shows a plan view of FIG. 5.

FIG. 6 schematically shows a plan view of FIG. 5. The individual sections 36*a*, 36*b*, 37*a*, 37*b*, 38*a*, 38*b* of the cores 34, 35 are rigidly connected to one another as shown. The cores 34, 35 are supported on one another via the elastic spacers 45 and are pressed against the inside 40. If a plurality of spacers 45 distributed over the entire length of the cores 34, 35 are used, displacements and deformations during the casting can be substantially reduced.

To produce the blade 13, 14, first of all the desired cores 34, 35 are preformed in a suitable mold (not shown) and then fired. They are then inserted into the prepared outer mold 30. The projections 39 of the sections 36*a*, 36*b*, 37*a*, 37*b* of the two cores 34, 35 are brought to bear against the inside 40 of the outer mold 30. For this purpose, either rigid or elastic spacers 44, 45 are inserted between the two cores 34, 35. After that, the two cores 34, 35 are fixed in the receptacles 43.

A suitable material, for example wax, is poured into the intermediate space between the cores 34, 35 and the inside 40 of the outer mold 30. After the wax has solidified, the outer mold is removed and the wax body is provided with a protective coating. This protective coating, as well as the cores 34, 35, may be made of a ceramic material.

The wax tool provided with the protective coating is fired again. The castable material for the blade 13, 14 is then introduced into the intermediate space between the protective coating and the cores 34, 35. After this material has solidified, the protective coating and the cores 34, 35 are removed in a suitable manner, for example flushed out with an acid or an alkaline solution.

The production and assembly tolerances which are present in the known methods and devices during the production and fixing of the cores 34, 35, of the wax tool and of the protective coating can be substantially reduced. The wall thickness of the outer walls 17, 18 of the blade 13, 14 can therefore be markedly reduced. This results in an improved cooling effect. The requisite strength of the blade 13, 14 is ensured by the center web 28.

The invention thus described, it will be obvious that the same may be varied in many ways. Such variations are not to be regarded as a departure from the spirit and scope of the invention, and all such modifications as would be obvious to one skilled in the art are intended to be included the scope of the following claims.

What is claimed is:

1. A device for producing a turbine blade having two outer walls and at least one cavity, arranged between the outer walls, comprising:

an outer mold and a plurality of cores for forming the outer walls and the at least one cavity, wherein each of the cores includes at least one section which extends from an associated outer wall up to a center web of the blade, without being involved in the formation of the other outer wall.

2. The device as claimed in claim 1, wherein the cores are fixed at at least one end in a receptacle of the outer mold in the longitudinal direction of the blade.

3. The device as claimed in claim 1, wherein the cores include projections for supporting on the outer mold.

4. The device as claimed in claim 3, wherein the projections taper starting from the cores in particular are of conical design.

5. The device as claimed in claim 4, wherein the projections are of conical design.

6. The device as claimed in claim 4, wherein the cores are supported on one another by at least one of rigid and elastic spacers.

7. The device as claimed in claim 6, wherein the spacers are wedge-shaped.

8. The device as claimed in claim 3, wherein the cores are supported on one another by at least one of rigid and elastic spacers.

9. The device as claimed in claim 8, wherein the spacers are wedge-shaped.

10. A method or producing a turbine blade having two outer walls and at least one cavity, arranged between the outer walls, comprising:

an outer mold and a plurality of cores, provided for forming the outer walls and the at least one cavity, wherein at least one section of each core is supported in such a way that a distance between the outside of the section of the one core and the inside of the outer mold is independent of a distance between the outside of the section of the other core and the inside of the outer mold, so that the wall thicknesses of the two outer walls, at least in the region of the sections, are formed independently of one another.

11. The method as claimed in claim 10, wherein the two cores are supported on the inside of the outer mold via projections, in order to ensure a minimum wall thickness of the outer walls.

12. The method as claimed in claim 11, wherein the two cores are supported on one another and are pressed against the inside of the outer mold.

13. The method as claimed in claim 12, wherein the two cores are supported on one another by at least one of rigid and elastic spacers.

14. The method as claimed in claim 10, wherein the two cores are supported on one another and are pressed against the inside of the outer mold.

15. The method as claimed in claim 14, wherein the two cores are supported on one another by at least one of rigid and elastic spacers.

16. A blade for a turbine, comprising:

two outer walls and at least one cavity arranged between the outer walls, wherein at least one cavity is divided into two passages by a center web, the at least one passage being arranged between the at least one outer wall and the center web and the other passage being arranged between the center web and the other outer wall, wherein the wall thickness of the center web is greater than the wall thickness of the outer walls.

17. The blade as claimed in claim 16, wherein the outer walls are connected to one another via a plurality of ribs for forming a plurality of cavities.

18. The blade as claimed in claim 17, wherein a cavity at at least one of a leading edge and a trailing edge of the blade is free of the center web.

* * * * *